US005118476A

United States Patent [19]

Dryer et al.

[11] Patent Number: 5,118,476

[45] Date of Patent: Jun. 2, 1992

[54] CATALYTIC CONVERTER AND SUBSTRATE SUPPORT

[75] Inventors: Leonard J. Dryer, Harrisonburg, Va.; Thomas J. Schwarte, Plymouth, Ind.

[73] Assignee: Tennessee Gas Pipeline Company, Lincolnshire, Ill.

[21] Appl. No.: 586,419

[22] Filed: Sep. 21, 1990

Related U.S. Application Data

[60] Division of Ser. No. 156,838, Apr. 1, 1988, Pat. No. 4,969,264, which is a continuation-in-part of Ser. No. 873,684, Jun. 12, 1986, abandoned.

[51] Int. Cl.[5] ..... B01D 53/36

[52] U.S. Cl. ..... 422/179; 422/171; 422/177; 422/180

[58] Field of Search ..... 422/168, 177, 179, 180, 422/181, 171

[56] References Cited

U.S. PATENT DOCUMENTS

| | | | |
|---|---|---|---|
| 3,227,241 | 1/1966 | Mattoon | 181/56 |
| 3,313,536 | 4/1967 | Dutton et al. | 267/64 |
| 3,523,590 | 8/1970 | Straw | 181/61 |
| 3,990,859 | 11/1976 | Waite | 23/288 FC |
| 4,020,539 | 5/1977 | Vroman | 29/157 R |
| 4,048,363 | 9/1977 | Langer et al. | 428/77 |
| 4,087,039 | 5/1978 | Balluff | 228/173 R |
| 4,155,980 | 5/1979 | Santiago et al. | 422/180 |
| 4,256,700 | 3/1981 | Smith et al. | 422/177 |
| 4,343,074 | 8/1982 | Bailey et al. | 29/157 R |
| 4,344,922 | 8/1982 | Santiago et al. | 422/179 |
| 4,347,219 | 8/1982 | Noritake et al. | 422/180 |
| 4,362,700 | 12/1982 | Hayashi et al. | 422/179 |
| 4,413,392 | 11/1983 | Otani et al. | 29/157 R |
| 4,504,294 | 3/1985 | Brighton | 55/502 |
| 4,629,605 | 12/1986 | Santiago | 422/179 |
| 4,969,264 | 11/1990 | Dryer et al. | 29/890 |

*Primary Examiner*—Robert J. Warden
*Assistant Examiner*—Amalia L. Santiago
*Attorney, Agent, or Firm*—Harness, Dickey & Pierce

[57] ABSTRACT

A catalytic converter of the automotive type comprises a converter housing body with a reduced central section that compresses a support mat around a substrate, the ends of the body being spherical for attachment to spherical flanges on end bushings or being an integral part of the body. The method of manufacturing the converter substrate and converter is also disclosed.

22 Claims, 3 Drawing Sheets

CATALYTIC CONVERTER AND SUBSTRATE SUPPORT

CROSS-REFERENCE TO RELATED APPLICATIONS

This is a division of U.S. patent application Ser. No. 07/156,838, filed Apr. 1, 1988 now U.S. Pat. No. 4,969,264 issued Nov. 13, 1990 which was a continuation-in-part of Appl. Ser. No. 07/873,684, filed Jun. 12, 1986, now abandoned.

BACKGROUND OF THE INVENTION

This invention relates to catalytic converters for internal combustion engine exhause systems and, in particular, to catalytic converters intended for installation in motor vehicles as original equipment by the vehicle manufacturer or as aftermarket replacements for original equipment converters.

BRIEF SUMMARY OF THE INVENTION

It is the purpose of the invention to reduce the size and number of parts in a catalytic converter (as compared with known practical constructions) while at the same time increasing its effectiveness and improving its construction and manufacture.

The invention achieves the foregoing purpose by means of a substrate support in the form of a tubular converter body which is reduced in diameter at a central portion to compress a support mat around a catalyst substrate. In one form, the ends of the body are formed to a spherical radius to produce a converter substrate support that can be shipped "as is" or assembled at once into a converter. This form of converter is completed by attaching inlet and outlet bushings to the ends of the substrate support and this can be done in the factory or at some point downstream. In another form, the body is in two halves, each of which has a bushing formed in it. One of the halves is reduced in diameter to hold the substrate and the other half is pressed over and secured to it.

This invention provides a construction and manufacture that results in a converter that is quite short in length, has few parts, has maximum effectiveness since 100% of the substrate end faces can be used, and has improved accuracy of substrate support, along with other advantages that will become apparent or be mentioned hereinafter.

DESCRIPTION OF THE PREFERRED EMBODIMENTS

Figure 1:
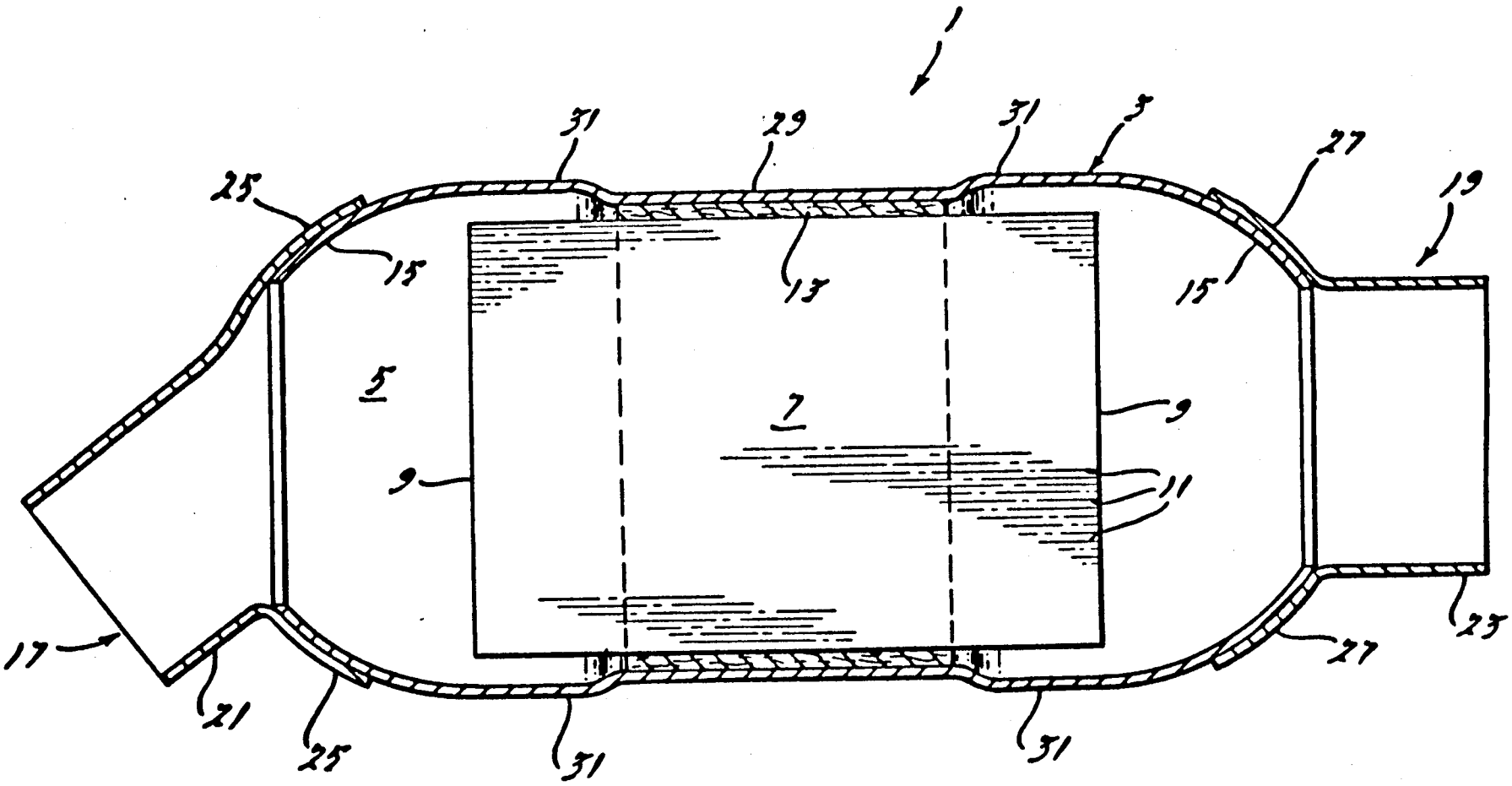
FIG. 1 is a longitudinal cross-section along the centerline or axis of a preferred form of converter embodying the invention.

Referring to FIG. 1, a catalytic converter 1 embodying the invention for use in motor vehicle exhaust gas systems comprises an open ended, tubular, preferably round and symmetrical, sheet metal body 3, the inside of which defines a chamber 5 for a round, symmetrical, ceramic monolith, honeycomb-type, catalyst substrate 7 (available on the open market) having flat ends 9 and a great number of catalyst coated, longitudinal honeycomb cell passages 11 extending from one end 9 to the other. The central portion of the substrate 7 (less than the full length) is surrounded by an annular, shock absorbent, resilient, insulative, support mat 13, which is preferably composed of a gas impervious vermiculite based material (available on the open market) that expands substantially upon heating. This is preferably about ¼" thick and radially compressed at assembly to about one half of its initial thickness. The opposite end portions 15 of the body 3 are preferably each formed or swaged to a partially spherical shape as illustrated having central openings substantially less in diameter than the diameter of substrate 7. Gas flow end bushings 17 and 19 have tubular outer ends 21 and 23, respectively, for attachment by welding or clamping, or otherwise, to exhaust system conduits (not shown). They also have outwardly flared annular partially spherical inner end flanges 25 and 27, respectively, each of which is preferably formed on a radius corresponding to that of the body end portions 15 to which they are welded in selected locations so that their ends 21 and 23 have the desired orientation with respect to the centerline or axis of the body 3. End 21 is shown oblique and end 23 is shown coaxial, but many other angular arrangements are accommodated by the mating spherical surfaces.

The body 3 is preferably formed from a length of uniform diameter and thickness metal tubing. The substrate 7, with the annular mat band 13 located centrally on it, is positioned centrally in chamber 5 and coaxially inside the tubing which is then uniformly reduced in diameter by suitable known means (e.g., see U.S. Pat. No. 3,382,948, FIGS. 2 and 2A) into a central, reduced diameter ring portion 29 of about the same length as mat 13 thereby uniformly radially compressing the mat around the outside of the substrate to about one-half its original or free state thickness, thus firmly though somewhat resiliently supporting the substrate in centered position. The ring portion 29 retains radial compression on the mat 13 and the two apply sufficient radial pressure to resiliently retain it in a centered position and serve as the sole means to shock mount and support the ceramic monolith. The body 3 has intermediate substantially uniform diameter portions 31 extending between opposite or outer ends of the central ring portion 29 and the inner ends of the spherical end portions 15, the spherical portions 15 being formed in the metal body 3 after the ring 29 is formed to hold the substrate in place. The portions 31 are radially spaced outwardly from the substrate 7 and preferably extend to about the ends 9 of the substrate whereupon the curvature into spherical end portions 15 begins.

If desired, bushings such as 17 and 19 can, after formation of end portions 15, be welded in place at the factory. Alternatively, the converter substrate, or body 3 with the substrate 7 and formed ends 15, can be sent downstream to the vehicle manufacturer, warehouse, repair shop, etc., where the desired end bushings can be attached to suit specific applications.

From the standpoint of a method of manufacture of converter 1, the body 3 is preferably initially in the form of a simple metal tube of uniform diameter, open at both ends. The mat 13 is placed around the midsection of the substrate 7 and this assembly is inserted or stuffed into the tube so that it is longitudinally and radially centered in the tube. While maintaining this centered relationship, the wall of the tube is radially compressed into the reduced diameter ring selection 29 which, by way of its radial contact with the mat 13, radially compresses it and applies radial pressure to the substrate 7. The radial deformation of ring 29 is sufficient to apply and retain enough radial pressure on the mat and substrate to permit shock absorption by the mat but still hold the substrate centered in the tube so that its end corners do not come in contact with the inner wall surface of the tube. After formation of the ring 29 so that the substrate 7 is held in place, radial pressure is applied to the ends of the tube to deform them inwardly into the spherical end portions 15 while still maintaining the sections 31 substantially cylindrical to preserve the clearance between them and the substrate 7. This completes the converter substrate and the converter is completed by welding the bushings 17 and 19 in place on the end portions 15. Alternatively, one of the spherical end portions 15 could be formed in the body before the substrate is inserted through the other end and held in place by formation of ring 29.

Figure 5:
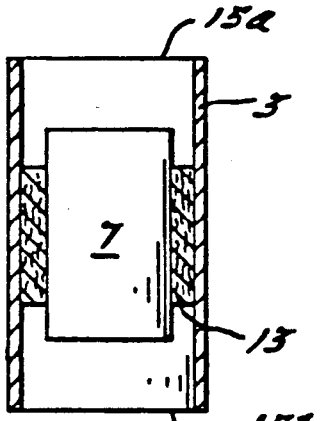
FIGS. 5-10 show one method of forming the catalytic converter shown in FIG. 1.
Figure 6:
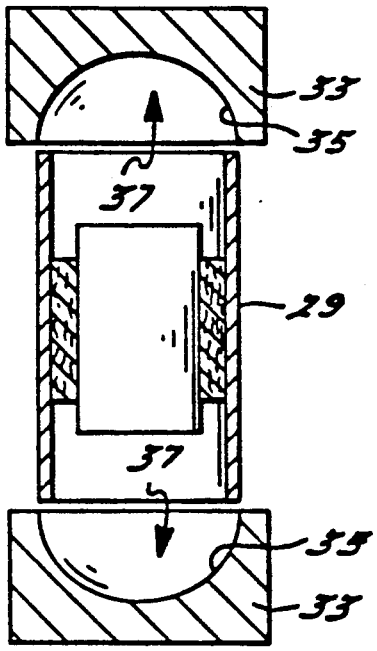
Figure 7:
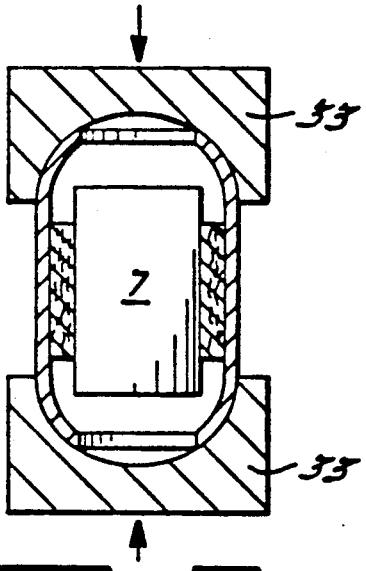

Referring to FIGS. 5-10, an alternative method of manufacturing is disclosed. In FIG. 5, mat 13 and substrate 7 are assembled as before and the assembly inserted into the tube which is open at its opposite axial ends indicated as 15*a* and 15*b*. While maintaining a longitudinally and radially centered relationship between ring 29 and mat 13, in FIGS. 6 and 7, a pair of forming dies 33 are positioned such that each die 33 is adjacent one of the opposite ends 15*a* and 15*b* of the tube, each die having a generally hemispherical surface 35 that defines a forming cavity 37. The dies are then axially advanced against the tube ends such that axial end portions of the tube are driven into the cavities 37 whereby the contoured hemispherical surfaces 35 progressively deform the tube end portions into the generally spherical end portions 15. Forming dies 33 simultaneously apply radial and axial pressures on the axial end portions to deform same and while the diameter of cavity 37 is greater than that defining the tube, the contour of surface 35 could be other than hemispherical if desired. Since the application of compressive axial force by dies 33 precedes formation of reduced portion 29, the column strength of the tube is retained to avoid wall collapse during shaping of the tube ends.

Figure 8:
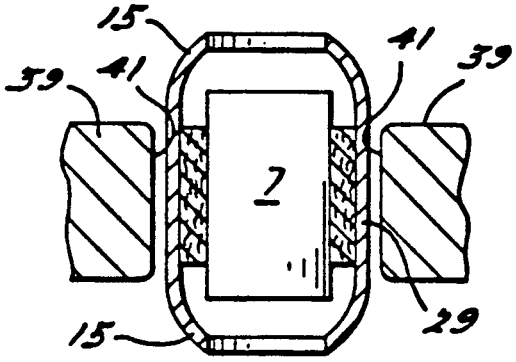
Figure 9:
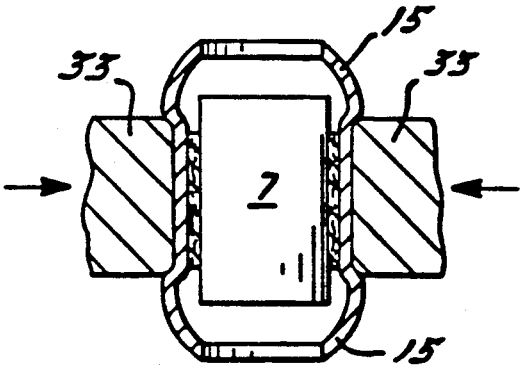
Figure 10:
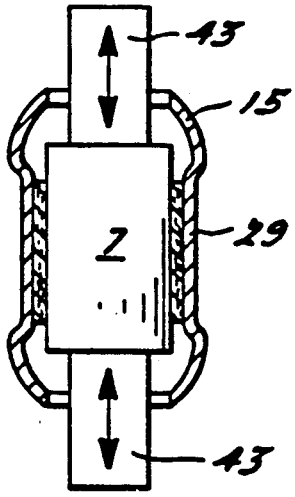

In FIGS. 8 and 9, two or more compression dies 39 each having a circular semicylindrical forming surface 41 are positioned about and simultaneously driven radially inwardly about the central portion 29 of the tube thereby resulting in the tube wall being uniformly radially deformed and driven into compressing contact with mat 13. The axial width of each forming surface 41 is selected to be substantially coextensive with that of mat 13. Desirably the angular extent of surfaces 41 is such that when the compression dies 39 reach their inwardmost travel the respective surfaces 41 cooperate to define a continuous 360° surface. Advantageously the compression dies assure that mat 13 is properly reduced in thickness and compressed radially between the substrate and the inner wall of the tube. FIG. 10 indicates that should the substrate need repositioning, arbors 43 are inserted through the openings formed by the hemospherical ends.

In use, the converter 1 would normally be secured into an exhaust system by welding or clamping of bushing portions 21 and 23 to exhaust system conduits. Either end can be the inlet. Exhaust gas flows through the longitudinal passages 11 which are catalyst coated to reduce oxides of nitrogen and to oxidize hydrocarbons and carbon monoxide in order to achieve acceptable emission levels. If a vermiculite base mat 13 is used, heat from the reaction during initial operation of the converter will cause it to significantly expand thereby enhancing the tightness of the connection between the substrate 7 and body 3 to act along with the relatively high frictional resistance to resist slipping of the substrate relative to the body 3. For the aftermarket, the substrate 7 will be selected, sized, and treated with catalyst to produce acceptable emission levels for a wide variety of different engines.

As an example of approximate size for automotive applications, the substrate 7 may be about 4" O.D. and about 5" long, and uniformly spaced about ⅛" from the inner surface of ring 29 and about ¼" from the inner surface of intermediate portions 31, and the overall length of the body 3 after forming of the spherical ends may be about 7-7-½". This is significantly less length than needed to support the substrate in a conventional manner in a similarly shaped body by means of L-shaped support rings. Additionally 100% of the end faces 9 and longitudinal passages 11 of the substrate can be used for conversion thereby increasing converter effectiveness. A further comparison with the L-ring support method shows that the number of parts in converter 1 has been reduced to only five and that the method of supporting the substrate by uniform radial compression applied through ring 29 achieves more accuracy in manufacturing thereby reducing the likelihood of scrap. The spherical end portions 15 and bushings 17 and 19 provide a "universality" feature that promotes smaller inventory, better service, and lower costs. The body 3, without bushings 17 and 19, comprises a substrate support which can be shipped with reduced likelihood of impact damage to the brittle ceramic substrate material because of the protection provided by the spherical ends and by the unique method of mounting the substrate which provides ample clearance for the corners of the substrate.

Figure 2:
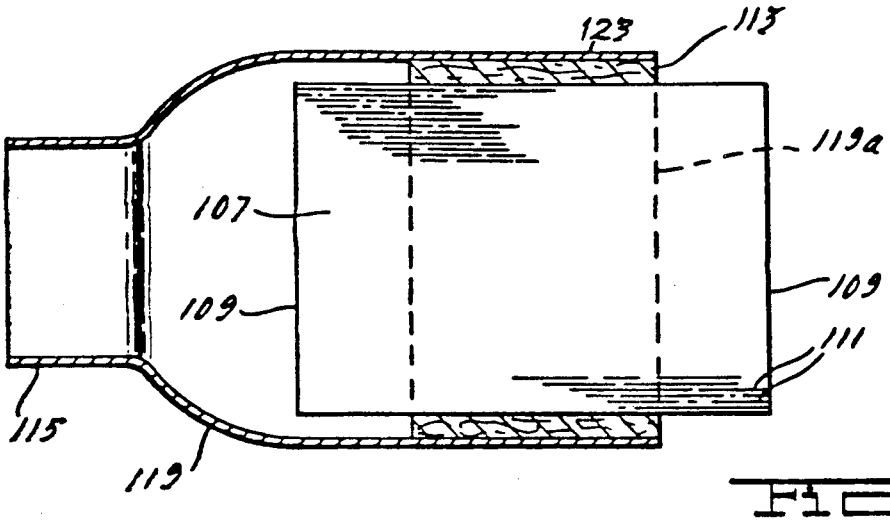
FIG. 2 is a longitudinal cross-section through one half of another form of the invention showing the mat and substrate after stuffing.
Figure 3:
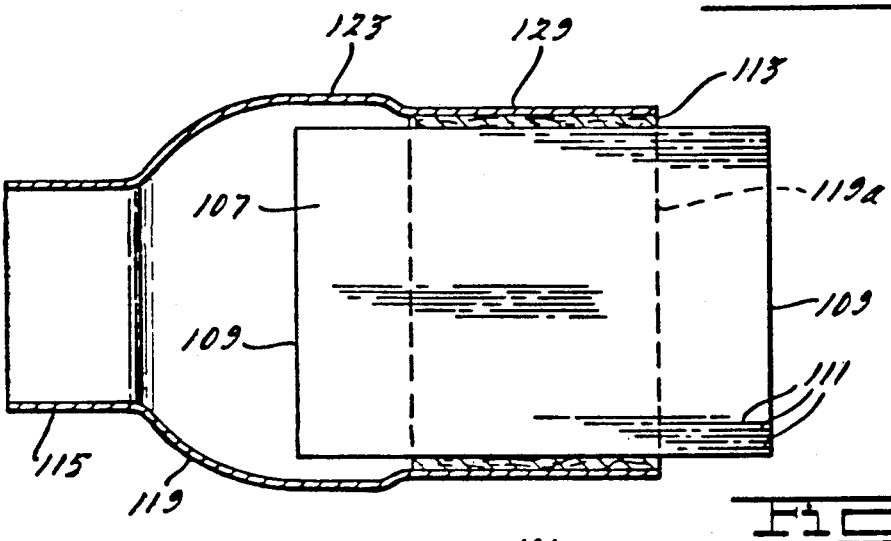
FIG. 3 is a section similar to FIG. 2 but showing the parts after reduction in diameter.
Figure 4:
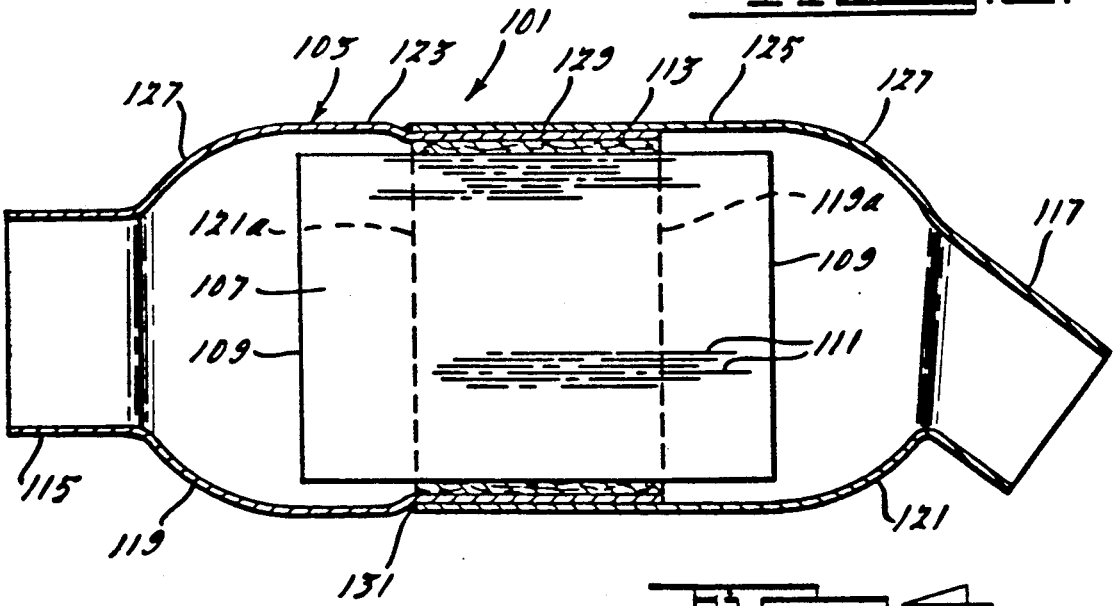
FIG. 4 is a longitudinal cross-section through the completed converter of FIGS. 2 and 3.

Referring to FIGS. 2-4, the invention is illustrated in the form of a converter 101 (FIG. 4) having an elongated, round tubular body 103 containing a catalyst substrate 107 (preferably the same as substrate 7) with flat ends 109 and longitudinal honeycomb cell gas passages 111 extending from one end of face 109 to the other. The central portion of substrate 107 is surrounded by a support mat 113 which is preferably the same as mat 13. Gas flow end bushings 115 and 117 are preferably integral with and formed by swaging or deforming metal in the ends, respectively, of body halves 119 and 121 which telescope together to form the body 103. Halves 119 and 121 may be formed or swaged and drawn from originally round cylindrical tubes that have uniform diameter and wall thickness inner end portions 123 and 125, respectively. Outer portions 127 of the halves are formed into segments that blend into the integral bushings 115 and 117. Segments 127 are illustrated as spherical, bushing 115 as coaxial with body 103, and bushing 117 as oblique to the axis of body 103.

As seen in FIG. 2, the substrate 107 and its central and symmetrically located mat 113 have an outer diameter which is about the same as the inner diameter of end portion 123 of body half 119 whereby the combined substrate and mat can be stuffed into the open end 119*a* of the half 119 and positioned with the outer end of the mat substantially coplanar with the end 119*a* (allowance preferably being made for longitudinal mat expansion as a result of radial compression). As seen in FIGS. 3 and 4, the end of portion 123 is reduced in diameter along section 129 by about the wall thickness of the halves 119 and 121 which is about 50% of the original thickness of mat 113. Reduced diameter section 129 is substantially the same in length as the compressed mat.

As seen from FIG. 4, the open end 121*a* of half 121 is telescoped over the reduced diameter section 129 of half 119 so that end portion 125 slides over section 129 for a desired length of overlap, the overlap illustrated in FIG. 4 being the length of mat 113 and section 129 though the overlap may be less. Thereafter, the end portion 125 and half 121 can be affixed to end portion 123 and half 119 as illustrated by the annular weld 131.

From the standpoint of a method of manufacture of converter 101, the two halves 119 and 121 are preferably initially each in the form of simple metal tubes of uniform diameter and open at both ends. One end of each of the halves is deformed by suitable drawing or swaging operations or the like to form sections 127 and the integral bushings 115 and 117 bearing the desired orientation with respect to the axis of the tube. The mat 113 is wrapped around the substrate, preferably being symmetrical with respect to the ends as illustrated, and this assembly stuffed into one of the halves (e.g., half 119) so that the trailing end of the mat is approximately coplanar with the end of the half (e.g., end 119*a*). Thereafter, the wall of the half containing the substrate is radially compressed into ring 129, the deformation along a radius preferably being substantially the wall thickness of metal tube from which the halves 119 and 121 are formed. The converter assembly is then completed by sliding or telescoping the second half (e.g., half 121) over the ring 129 (which now has an outer diameter that is substantially the same as the inner diameter of the second half) for the desired amount of overlap and welding or otherwise affixing the two halves together. If both bushings 115 and 117 are oblique to the axis of converter 101, the second half will also be angularly positioned in the desired location before it is welded to the first half.

While halves 119 and 121 are shown with integral end bushings 115 and 117, the integral bushings 115 and 117 could be omitted (so that the body 103 is a substrate support) and the gas flow bushings could be add-ons as shown at 17 and 19 for converter 1 in FIG. 1 in which case it would be important to have the end sections of the halves spherically shaped as shown at 127. Another modification would be to have spherical ends 127 with no openings at all (except for an air vent for assembly purposes, if necessary) whereby the installer of the converter would cut the gas flow openings at the desired positions and weld on end cap type bushings such as 17 and 19 of FIG. 1. This modification provides maximum protection against damage to the substrate during shipping and storage. The basic idea of spherical ends, open and closed, for a catalyst converter is disclosed and claimed in a copending application assigned to the assignee hereof of Robert L. Sager, Jr., filed Mar. 31, 1986, Ser. No. 846,058, entitled Automotive Type Catalytic Converter.

For best results, it is important in both converters 1 and 101 to select the appropriate length for the mat 13 or 113. If the mat is too long, fibers may break off or be liberated by gas pulsations and get into the longitudinal cell passages 11 or 111 and plug them. Also, if the mat is too long a phenomenon known as "ring-off" may occur that could produce temperature gradients on the substrate that would put it in tension which could lead to cracking in the center. On the other hand, if the mat is too short, the substrate could rock or resonate causing damage if it impacts on the metal body 3 or 103. To minimize these possibilities, it is desirable that the mat length be in the range of 50% to 90% of the substrate length, preferably about 60%. At these lengths, there is special benefit in that it is believed that a static condition develops in the space between the outer diameter of the exposed ends of the substrate and the walls of the bodies 3 and 103 wherein the gas is relatively stagnant. This is thought to protect the ends of the mat and tend to minimize the chance that fibers will come loose and get into the substrate.

Modifications may be made in the specific details shown and described without departing from the spirit and scope of the invention. For example, while spherical end portions 15 are preferred for converter 1, advantages of the invention will still be obtained if conventional end cone bushings are attached to sections 31 instead of the flange bushings 17 and 19 that are shown.

We claim:

1. In a catalytic converter of the type used in motor vehicle systems, said converter including an elongated cylindrical body having a pair of enlarged diameter cylindrical end portions defining inlet and outlet ends and a reduced diameter cylindrical central portion which joins said inlet and outlet ends, a catalyst substrate supported in said body, and a tubular shock absorbent mat having opposite longitudinal ends and fitted about said catalyst substrate prior to assembly of said substrate inside said cylindrical body, the improvement wherein said support mat is of uniform thickness between its opposite ends and is held in place about the substrate by said central portion, said support mat acting to hold the substrate in position in the body, wherein said support mat and central reduced diameter portion serve as the sole support means for the substrate.

2. The improvement as claimed in claim 1 wherein said mat is composed of a material that expands upon heating and thereby increases the radial compression between the substrate and reduced diameter portion.

3. The improvement as claimed in claim 1 wherein said body has cylindrical portions extending longitudinally away from opposite sides of said reduced portion and radially spaced from the outer surface of the substrate by an amount substantially greater than the thickness of the mat.

4. The improvement as claimed in claim 3 wherein said mat and central portion are substantially equal in length.

5. The improvement as claimed in claim 1 wherein said mat is composed of fibrous material and the length of the mat is about 50–90% of the length of the substrate.

6. The improvement as claimed in claim 1 wherein the body is open at the ends and has end portions attached to gas flow end bushings.

7. The improvement as claimed in claim 6 wherein said end portions are spherically shaped.

8. The improvement as claimed in claim 1 wherein said body has spherically-shaped end portions.

9. The improvement as claimed in claim 1 wherein said body comprises one piece and said central portion is formed in said one piece.

10. The improvement as claimed in claim 1 wherein said body comprises two sections telescoped together and said reduced diameter central portion is formed in an end of one of the two sections, and the other of the two sections fits over said reduced diameter central portion.

11. In a catalytic converter of the type used in motor vehicle exhaust systems, said converter including a cylindrical body having inlet and outlet ends and a reduced diameter central portion joining said ends, a cylindrical catalyst substrate having opposite end faces inside the body, and a resilient support mat having opposite ends and fitted around a central portion of the substrate, the improvement wherein said body has a gas flow end bushing at each opposite end thereof, said cylindrical body central portion is compressed against the mat, and said support mat is of uniform thickness between its ends and is held in place by said cylindrical body central portion, wherein said support mat and central reduced diameter portion serve as the sole support means for the substrate.

12. The improvement as claimed in claim 11 wherein the end portions of the body are spherically shaped and said end bushings have spherically shaped flanges attached to said spherical end portions.

13. The improvement as claimed in claim 11 wherein the body comprises one piece and said central reduced diameter portion is formed in said one piece.

14. The improvement as claimed in claim 11 wherein said body comprises two sections telescoped together and said reduced diameter central portion is formed in an end of one of the sections and the other section fits over said reduced diameter central portion.

15. The improvement as claimed in claim 11 wherein the mat and central reduced diameter portion are substantially coextensive in length and such length is within the range of about 50-90% of the length of the substrate.

16. The improvement as claimed in claim 15 wherein such length is about 60% of the length of the substrate.

17. The improvement as claimed in claim 11 wherein at least one of the gas flow end bushings is oblique to the axis of the body.

18. The improvement as claimed in claim 11 wherein said mat is composed of a heat expandable fibrous material and has a length substantially within the range of about 50-90% of the length of the substrate.

19. The improvement as claimed in claim 18 wherein said body has cylindrical wall portions radially spaced from the end portions of the substrate projecting beyond said mat for a distance substantially the same as that of the projecting ends of the substrate.

20. The improvement as claimed in claim 19 wherein said body has end portions extending outwardly from the outer ends of said cylindrical wall portions and said end portions being spherically shaped.

21. The improvement as claimed in claim 20 wherein said end portions commence in planes substantially coincident with the end faces of the substrate.

22. In a catalytic converter of the type used in motor vehicle exhaust systems, a converter subassembly comprising a tubular catalyst substrate having opposite end faces and a tubular shock absorbent mat having opposite ends inwardly of the respective end faces and disposed around said substrate, and an elongated tubular body having enlarged diameter end portions joined by a reduced diameter central wall portion, the improvement comprising said central wall portion encircling and compressing the mat radially inwardly against the substrate to hold the substrate in position in the body, said support mat being of uniform thickness between its opposite longitudinal ends and disposed centrally between said enlarged diameter end portions, wherein said support mat and central reduced diameter portion serve as the sole support means for the substrate.

* * * * *